US006511023B2

(12) United States Patent
Harland

(10) Patent No.: US 6,511,023 B2
(45) Date of Patent: Jan. 28, 2003

(54) AUTOMATED RAILWAY MONITORING SYSTEM

(76) Inventor: Sydney Allen Harland, 2155 Winchester Court, Burlington (CA), L7P 3M7

( * ) Notice: Subject to any disclaimer, the term of this patent is extended or adjusted under 35 U.S.C. 154(b) by 0 days.

(21) Appl. No.: 09/828,808

(22) Filed: Apr. 10, 2001

(65) Prior Publication Data

US 2001/0022332 A1 Sep. 20, 2001

Related U.S. Application Data

(63) Continuation-in-part of application No. 09/235,389, filed on Jan. 22, 1999, now Pat. No. 6,241,197.

(51) Int. Cl.[7] ..... B61L 25/02
(52) U.S. Cl. ..... 246/122 R; 246/124
(58) Field of Search ..... 246/3, 1 C, 122 R, 246/123, 124, 187 B, 182 R; 342/42, 71

(56) References Cited

U.S. PATENT DOCUMENTS 3,825,734 A * 7/1974 Jacobs et al. ..... 177/25.14
4,134,464 A * 1/1979 Johnson et al. ..... 177/163
5,072,900 A * 12/1991 Malon ..... 246/182 B
5,436,631 A * 7/1995 Magori et al. ..... 342/42
5,678,789 A * 10/1997 Pipich ..... 246/3
5,777,547 A * 7/1998 Waldrop ..... 340/438
5,950,966 A * 9/1999 Hungate et al. ..... 246/62
6,371,417 B1 * 4/2000 Southon ..... 246/247

* cited by examiner

*Primary Examiner*—S. Joseph Morano
*Assistant Examiner*—Frantz F. Jules
(74) *Attorney, Agent, or Firm*—Lieberman & Brandsdorfer, LLC

(57) ABSTRACT

A method and apparatus for determining the real time location of wheeled cars linked together in a train traveling on a fixed track. The method creates a wheel count and a location point for the train by counting the number of wheels on the train in a sequential order as the train passes a first wheel counting station, wherein the wheel counting station is stationary at a fixed location. The wheel count and location point for the train is then recorded in a computer. As the train passes subsequent wheel counting stations positioned along the track, the train is identified by recounting the wheels on the train and matching the number of recounted train wheels to the wheel count. The location point of the train is updated in the computer to correspond to the location of the last wheel counting station and to count the number of wheels on the train. Subsequently, a rail car location in the computer is created, wherein the rail car location corresponds to the last updated location point for the train. Accordingly, the method apparatus use a plurality of wheel counting stations, sensors, and a computer to determine the location of linked cars on a fixed track.

24 Claims, 7 Drawing Sheets

AUTOMATED RAILWAY MONITORING SYSTEM

CROSS-REFERENCE TO RELATED APPLICATIONS

This application is a continuation-in-part of application Ser. No. 09/235,389, filed Jan. 22, 1999, entitled Automated Railway Crossing, now U.S. Pat. No. 6,241,197, the disclosure of which is hereby incorporated by reference.

FIELD OF THE INVENTION

The present invention relates to a modular communication system that monitors railcar movement along a train line.

BACKGROUND OF THE INVENTION

Rail is an important method of transporting goods and people to and from populated areas. Rail is often used to ship goods in bulk over long distances in specialized container cars. Due to the variety of different types of goods which can be shipped by rail, a variety of different types of rail cars are often used to carry different types of goods. For example, perishable food items are often transported in refrigerated rail cars, whereas liquified gases are often carried in pressurized liquid container cars. In order to maximize the cost effectiveness of shipping cargo by rail, an individual train may consist of several engines linked to multiple rail cars. Indeed, a train may comprise literally hundreds of different types of cars carrying different types of goods, destined for different destinations. When a train enters a rail yard, several cars may be removed from the train while other cars are added to it, depending on the ultimate destination of the particular rail cars. Hence, the particular composition of a train will change as it moves from rail yard to rail yard. In many cases, a particular cargo item will be placed on a rail car which is assembled into a first train which leaves its departure point in one city. Before that cargo item reaches its ultimate destination in another city, the rail car on which that cargo item rode, may have been part of two or more separate trains. Likewise, the exact composition of a train may vary considerably from rail yard to rail yard as rail cars are removed and additional rail cars are added.

Since different rail cars on a train may have different points of departure and different destinations, it becomes vitally important to keep an accurate track of the different cars comprising a train. Traditionally, each rail car has an identification tag which has information concerning that car, including its point of departure, its destination and/or its cargo. To keep track of where particular rail cars are, an operator must first identify each rail car by reading the rail car tags. This can be a time consuming operation. In recent years, rail car tags have been developed which can be read by a wayside computerized optical card reader. In practice, however, since rail cars are being transferred at various customer locations along the track, the composition of the train as it travels from customer location to customer location is very difficult to trace.

Keeping track of the location of particular rail cars has also been a problem since rail car tags are generally read when the cars enter and leave a rail yard. Hence, it was only when the rail car was in a rail yard that the precise location of the car could be determined. While automatic wayside rail car tag readers may be used, cost limits their use to a few locations. Customers and/or rail way personnel had no practical method to determine the exact location of particular rail cars when the rail cars were in transit. Since a train may travel literally hundreds of miles from tag reader to tag reader, it is difficult for a rail company to know precisely where any particular shipment may be. As a result, it is very difficult for customers who are having cargo shipped by rail to determine with confidence where their cargo is, and what the expected time of delivery will be for the cargo.

SUMMARY OF THE INVENTION

The present invention overcomes the drawbacks of the prior art by providing a method of monitoring the progress of rail cars linked together in a train. The method comprises the steps of creating a wheel count and a location point for the train by counting the number of wheels on the train in sequential order as the train passes a first wheel counting station having a known location, the location point corresponding the location of the first wheel counting station. The wheel count and location point are then recorded in a computer. The train is then identified as the train passes subsequent wheel counting stations positioned along the track by recounting the wheels on the train and matching the number of recounted train wheels to the wheel count, each of said wheel counting stations having a known location. The location point in the computer is then updated when the train is identified to correspond to the location of the last wheel counting station to count the number of wheels on the train. Then a rail car location is created in the computer, the rail car location corresponding to the last updated location point for the train.

The present invention also directed at a system for determining the real time location of wheeled rail cars linked together in a train travelling on a fixed track. The system includes a plurality of wheel counting stations positioned along the track, the wheel counting stations each adapted to accurately count the wheels of the train as the train passes the station to create a wheel count for the train, the wheel count corresponding to the total number of wheels counted by the wheel counting station, each wheel counting station having a known location. The wheel counting stations are each adapted to transmit an information signal to a first computer operatively coupled to the wheel counting stations when the train passes the stations, said information signal including the wheel count for the train and location information corresponding to the location of the wheel counting station generating the wheel count. The first computer is adapted to store the wheel count and location information in a memory module. The first computer is also adapted to identify the train when it passes a wheel counting station by matching the number of wheels counted by said wheel counting station to the wheel count for the train. The first computer is further adapted to generate a location point corresponding to the location of the last wheel counting station to count the number of wheels on the train. Also, the first computer is adapted to create a rail car location corresponding to the location point.

The invention is also directed to a system for minimizing the distance between trains travelling on a fixed track, the trains each having a plurality of wheels. The system includes a plurality of wheel counting stations positioned along the track. The wheel counting stations are each adapted to accurately count the wheels of each train as the train passes the station and generate a wheel count for each train corresponding to the number of wheels on the train counted by the wheel counting station, each wheel counting station having a known location. The wheel counting stations are adapted to transmit an information signal to a remote computer operatively coupled to the wheel counting stations when the trains pass the stations, said information signal including the wheel count for each train and location information corresponding to the location of the wheel counting station generating the wheel count. The first computer is adapted to store the wheel count and location information for each train. The first computer is further adapted to identify each train when they pass a wheel counting station by matching the number of wheels counted by said wheel counting station to the wheel count for the respective trains. The first computer is further adapted to generate and store a location point for each train corresponding to the location of the last wheel counting station to count the number of wheels on the train. The wheel counting stations are also adapted to measure the speed and direction of the wheels and record the time the wheels were counted for each train. Each of the wheel counting stations are also adapted to transmit the speed, direction and time for each train to the first computer. The first computer has a computer program adapted to calculate and store the estimated size of each train from the respective wheel counts of each train. The computer program is adapted to calculate a minimum safe stopping distance for each train from the respective size of the trains, the recorded times the trains have passed the same wheel counting stations, and the respective speed and direction of the trains recorded when the trains passed said same counting stations.

DETAILED DESCRIPTION OF THE INVENTION

The present invention is a system and method for tracking the real time location of rail cars and trains as they proceed along a fixed track. The system tracks the progress of trains along the track by periodically identifying the trains as they pass monitoring stations having known locations. Each train is identified by first creating a wheel profile for the train consisting of a list of the rail cars forming the train and the known number of wheels on the train. The profile for each train is stored in a central computer which is readily accessible by a user through the internet or the world wide web. A plurality of wheel counting stations are positioned along the entire length of the track. Each wheel counting station has a known location and is adapted to accurately count the number of wheels on passing trains and transmit this information to the computer. The computer is pre-loaded with software which is adapted to identify the train passing a particular wheel counting station by matching the number of wheels counted by the wheel counting station to the recorded number of wheels for each train. Since there will be relatively few trains having identical numbers of wheels, it is possible to identify each train by its number of wheels. When the train passing a particular wheel counting station is identified, its location is then known since the location of the wheel counting station is also known.

Figure 1:
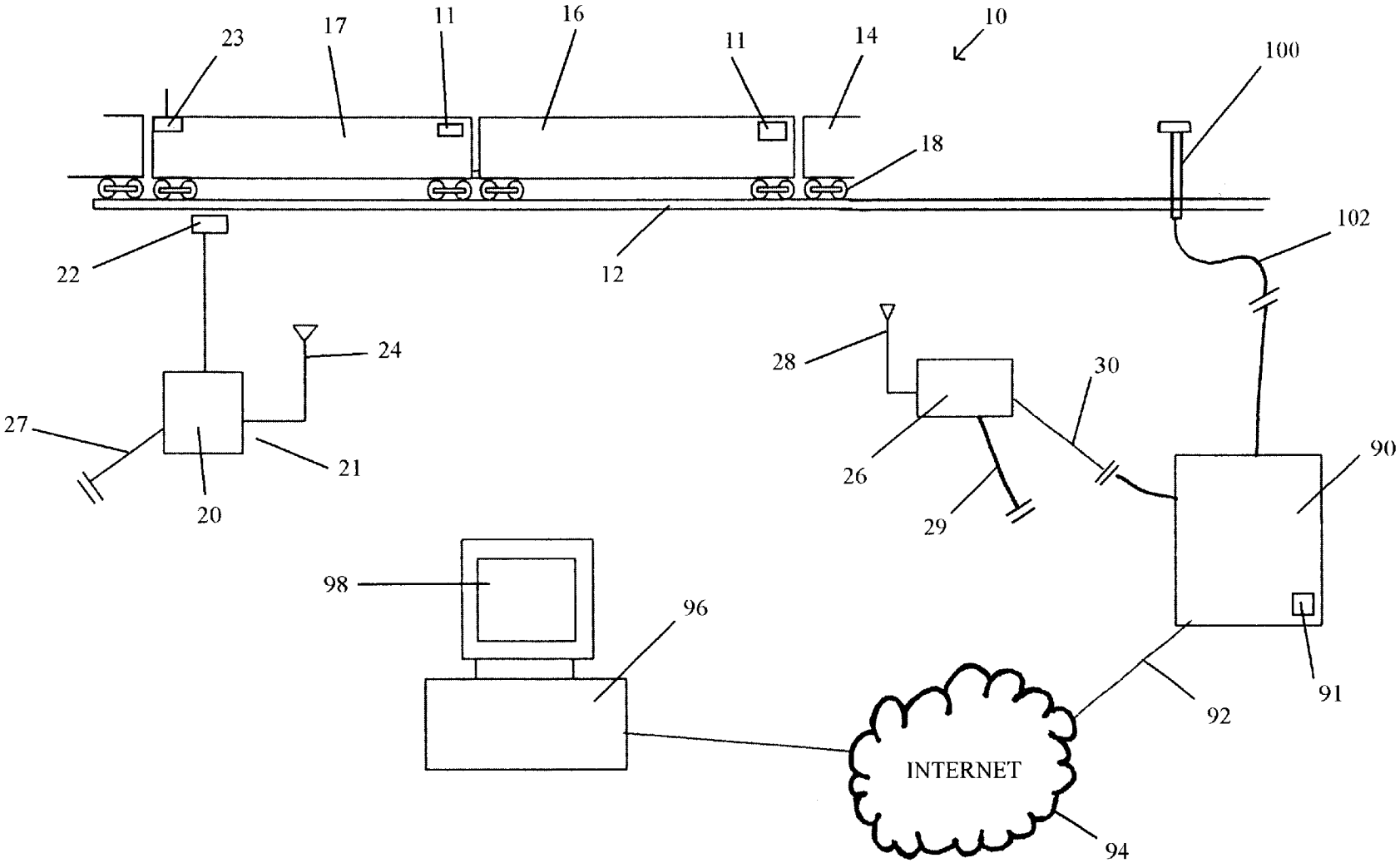
FIG. 1 is a schematic view of a rail monitoring system made in accordance with the present invention.

Referring firstly to FIG. 1, a rail way line which incorporates the rail traffic monitoring system of the present invention is shown generally as item 10. The railway line consists of rail track 12 upon which train 14 travels. Train 14 consists of a plurality of rail cars 16 linked together to form a train. Each of the rail cars ride on top of rail track 12 via metal wheels 18. It will be appreciated that train 14 can consist of a number of different types of rail cars. The rail monitoring system includes a plurality of wheel monitors 21 positioned along track 12, a receiver 25, a tag reader 100 and a remote computer 90. Monitor 21 consists of a computer unit 20 operatively coupled to a wheel sensor 22. Wheel sensor 22 is mounted adjacent to track 12 and is adapted and configured to accurately and precisely count the number of wheels 18 which pass by the wheel sensor. Wheel sensor 22 is adapted to transmit information concerning the passage of each wheel to computer 20 which stores that data as a wheel count. Wheel sensor 22 is also adapted and configured to measure the speed and direction of the wheels 18 as they pass the sensor. Information concerning the wheel speed and direction are transmitted from wheel sensor 22 to computer 20 which stores the information pertaining to the speed and direction of the car. Computer 20 also records the time train 14 passed wheel sensor 20. Computer 20 is configured to communicate with receiver 25 and to transmit the wheel count, speed, and direction information to the receiver. Preferably computer 20 has a radio modem operatively coupled to a radio antenna 24 for transmitting said information; alternatively, computer 20 may send that information via a communication line 27. Preferably, there will be several wheel monitors 21 operatively coupled to each receiver 25, with each receiver 25 acting as a receiving and relay station for transmitting the information collected by the wheel monitors to central computer 90.

Each rail car 16 has a rail identification tag 11. Rail identification tag 11 contains information identifying the rail car and its contents. Each rail car has a unique identification number which identifies the rail car. This identification number, together with information concerning the contents of rail car, are stored in identification tag 11. The information stored in a rail car identification tag 11 can be read automatically by tag reader 100 as rail cars 16 pass the tag reader. Tag reader 100 is operatively coupled to communication line 102 which is in turn operatively coupled to remote computer 90. Several automatic tag readers are available on the market from manufacturers such as AEI.

Receiver 25 consists of a computer 26 which is operatively coupled to either radio antenna 28 or communications line 29 and is adapted to receive communication signals from computer 20. The computer 26 receives the wheel count, speed and direction information from computer 20 either via a radio modem which is operatively coupled to radio antenna 28 or through a communications line 29 which is operatively coupled to communications line 27. The computer 26 is also adapted and configured to transmit this information to a remote computer 90 via a modem which is operatively coupled to communication line 30. Preferably communication line 30 is a high speed communication line such as a T3, satellite uplink, a fibre optic cable, a high speed long distance radio modem communication line or some other high speed communication system.

The information concerning the wheel count, speed and direction of train 14 and the rail car ID numbers are stored by remote computer 90 in memory 91. Preferably this information is organized in memory 91 in the form of a database which correlates train 14, individual rail cars 16, and the cargo that each car carries. Memory 91 also stores the schedule for train 14, including the location of customer drop-off and pick up facilities. Each train is identified by a particular train identification code which corresponds to the schedule for that train.

Train 14 may have specialized rail cars 17 which have communications transmitters 23. Specialized rail car 17 may be specialized to carry particular types of cargo such as perishable goods or liquified gases. Transmitters 23 are computer based communication transponders which are configured to obtain information concerning the status of specialized car 17. For example, if specialized car 17 consists of a refrigerated car having its own power generation system, transmitter 23 may be adapted to receive information concerning the temperature of the refrigeration compartment, the status of the refrigeration unit and how much fuel is in the power generation unit. Monitor 21 is adapted to interrogate transmitter 23 via a radio signal sent through antenna 24. When interrogated by signal from monitor 21, transmitter 23 then transmits a radio signal containing information concerning the status of rail car 17. Computer 20 is adapted to receive this radio signal and transmitted to computer 26 via communication line 27 or through a radio transmission through antenna 24. Receiver 25 is adapted to receive the information concerning the status of car 17 and transmits this information to remote computer 90 through communications line 30. The software in computer 90 is adapted to integrate this information into computer memory 91, which may be made available to remote users via the internet.

Figure 7:
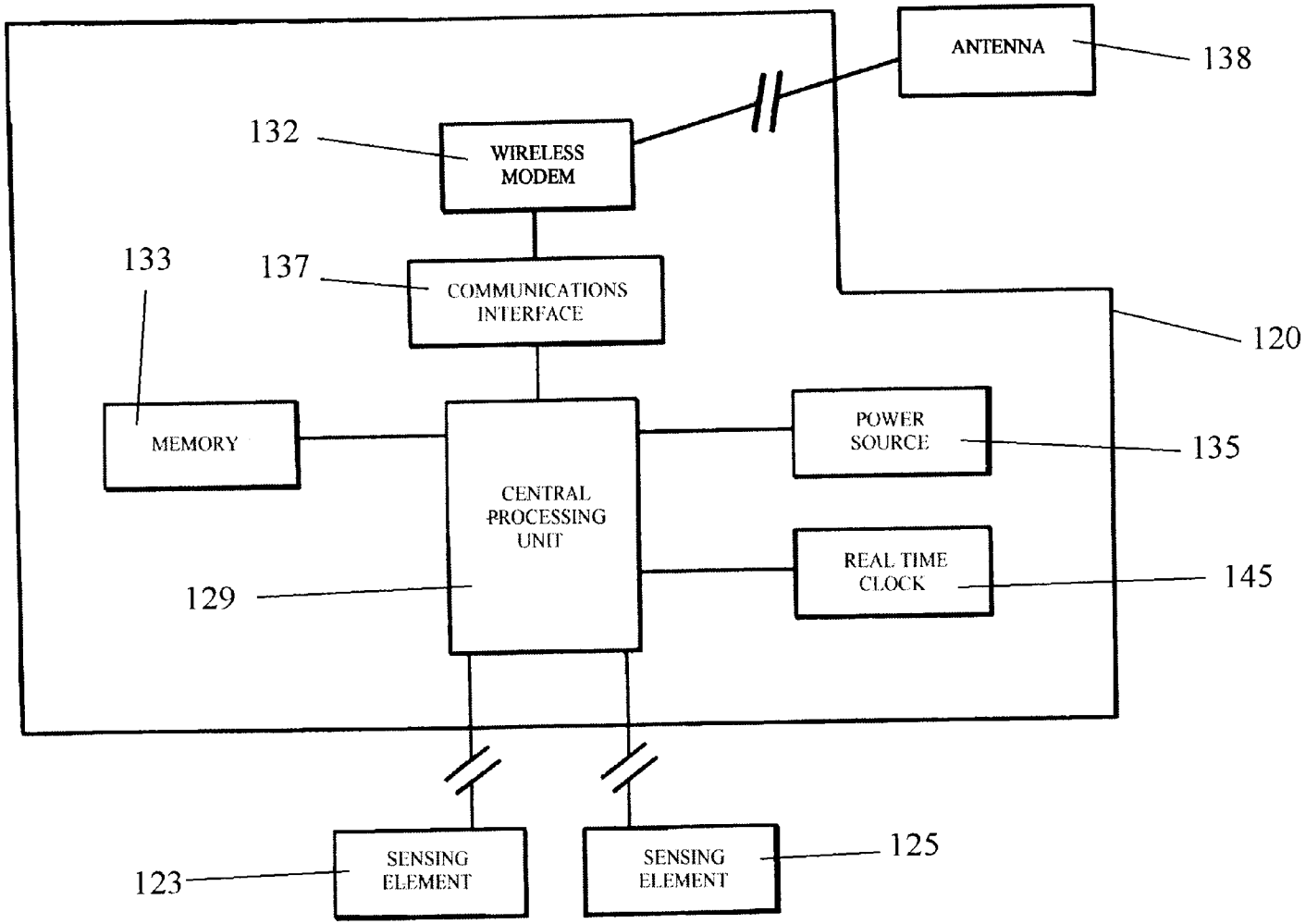
FIG. 7 is a schematic view of a wheel counting station of the present invention.

Referring now to FIG. 7, the construction and operation of a typical wheel counting monitor 120 used in the present invention shall be explained. Wheel monitor 120 includes a central processing unit 129 operatively coupled to memory 133, real time clock 145, wheel sensing elements 123 and 125 and power source 135. Sensing elements 123 and 125 are adapted to sense the presence of a train wheel (not shown) when the wheel comes into close proximity to the sensing element. Preferably, sensing elements 123 and 125 comprise eddy current sensors. Suitable eddy current sensors are available on the market. Alternatively, sensing elements 123 and 125 may comprise photo-switches which are adapted to optically sense the presence of a train wheel. When sensing elements 123 and 125 sense the presence of a wheel, they immediately send an electronic signal to central processing unit 129.

Memory 133 will store the software required by the processor to calculate the speed and direction of the train from the electronic signals received by wheel sensing elements 123 and 125. The distance between sensing elements 123 and 125 is stored in memory 133, therefore enabling monitor 120 to determine the speed of passing trains by dividing the distance between the sensing elements by the time interval between the signals received from the two sensing elements. Monitor 120 can also calculate the direction the train is travelling by noting which sensing element sends the first electronic sensor. Preferably, sensing elements 125 and 123 are sufficiently precise that they can signal processor 129 with each train wheel that passes, enabling the processor to count the number of wheels passing the sensing elements. The number of wheels counted may be stored in memory 133, together with the speed and direction of the passing train. Central processing unit 129 may comprise any high speed processor such as a Pentium TM 486 or greater. Central processing unit 129 and memory 133 are mounted on a suitable circuit board. Prefabricated boards having suitable processors and memory as well as additional supporting circuitry, are commercially available.

Preferably, central processing unit 129 is operatively coupled to a communications interface 137 which is in turn operatively coupled to wireless modem 132. Wireless modem 132 comprises a high speed communications radio modem adapted to operate at 19 K baud or higher. Wireless modem 132 has an effective range sufficient to reliably communicate with third processor 134. Wireless modem 132 is operatively coupled to antenna 138 which is preferably mounted on a tower to increase the effective range of the modem. Alternatively, communications interface 137 may be operatively coupled to a wired modem (not shown), which is in turn connected to a telephone, fibre optic or other suitable communications line.

Central processing unit 129, memory 133, sensing elements 123 and 125 and wireless modem 132 are all powered by power source 135. Power source 135 can be a simple rectified transformer coupled to line current. Alternatively, power source 135 can be a battery backed solar energy source.

Figure 2:
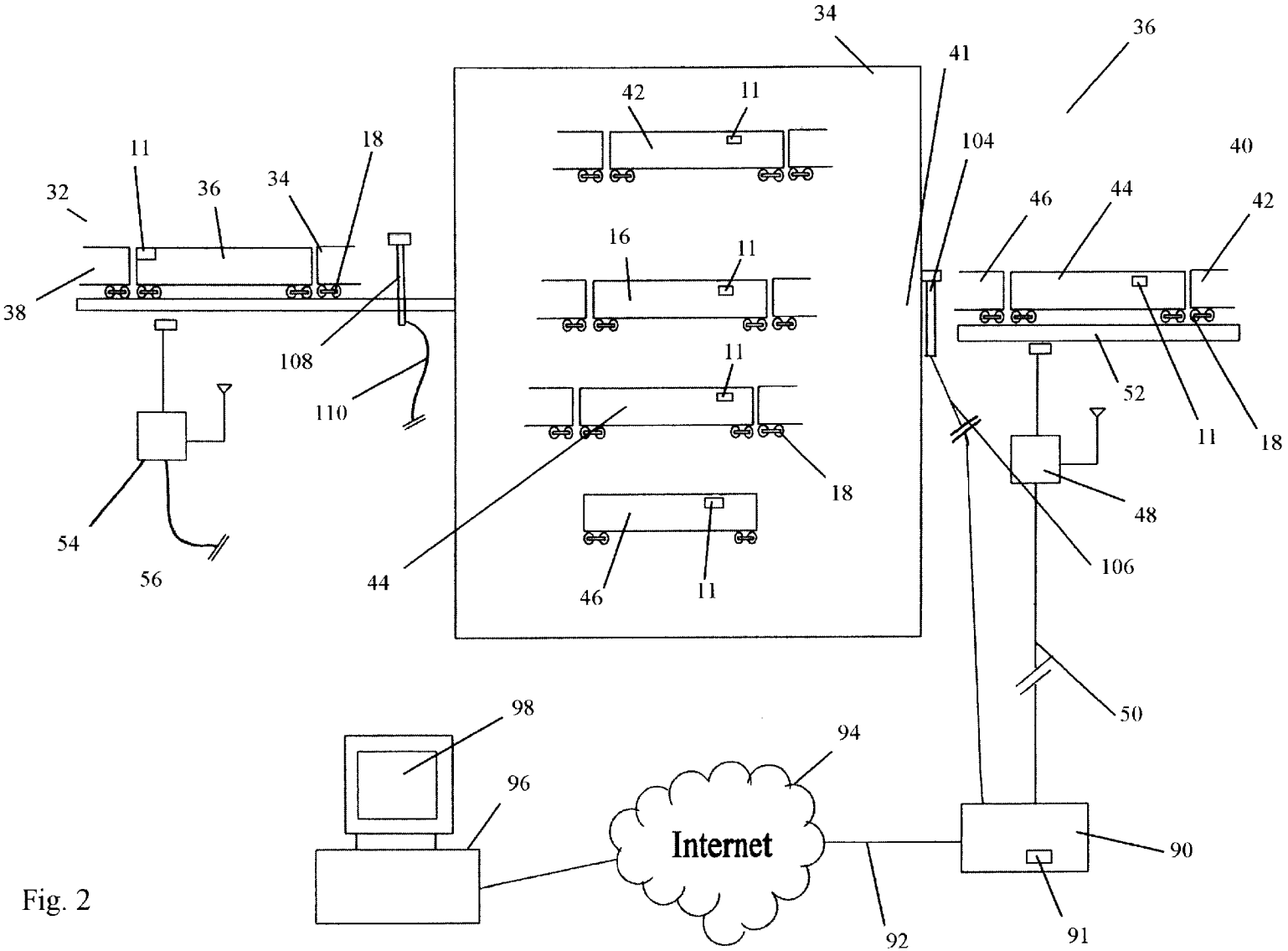
FIG. 2 is a schematic view of the rail monitoring system of the present invention as applied to a rail yard.

Referring now to FIG. 2, the method of the present invention shall now be discussed in greater detail by way of example. The example starts with the assembly of a train at a rail yard and then follows the train as it travels down the track. Train 40 is assembled from a plurality of rail cars 16 which are coupled together in rail yard 34. For example, rail cars 42, 44, and 46 may be joined together to be part of train 40, depending on the instructions given to rail yard personnel. As train 40 passes rail yard exit 41, tag reader 104 reads tags 11 on each of the cars as they pass the tag reader. The tag information is communicated to remote computer 90 via communication line 106. In close proximity to tag reader 104 is positioned wheel monitor 48 which counts wheels 18 as train 40 passes. Wheel monitor 48 is operatively coupled to communication line 50 which carries the wheel count information from monitor 48 to remote computer 90. The wheel count information is also stored in memory 91 and is correlated to the rail car tag information collected by tag reader 104. Train 40 then moves along track 52 to its final destination. Another train 32 having rail cars 35, 36 and 38 can enter rail yard 34. Wheel monitor 54 counts wheels 18 of each of cars 35, 36, and 38 as the cars pass the wheel monitor. Wheel monitor 54 transmits this wheel count information to remote computer 90 via communication line 56. This wheel count information is again stored in computer memory 91. As cars 35, 36, and 38 enter rail yard 34, their identification tags 11 are read automatically by tag reader 108. Tag reader 108 transmits this tag information to remote computer 90 via communication line 110. Again, memory 91 correlates the wheel count information to the tag information for train 32.

Figure 3:
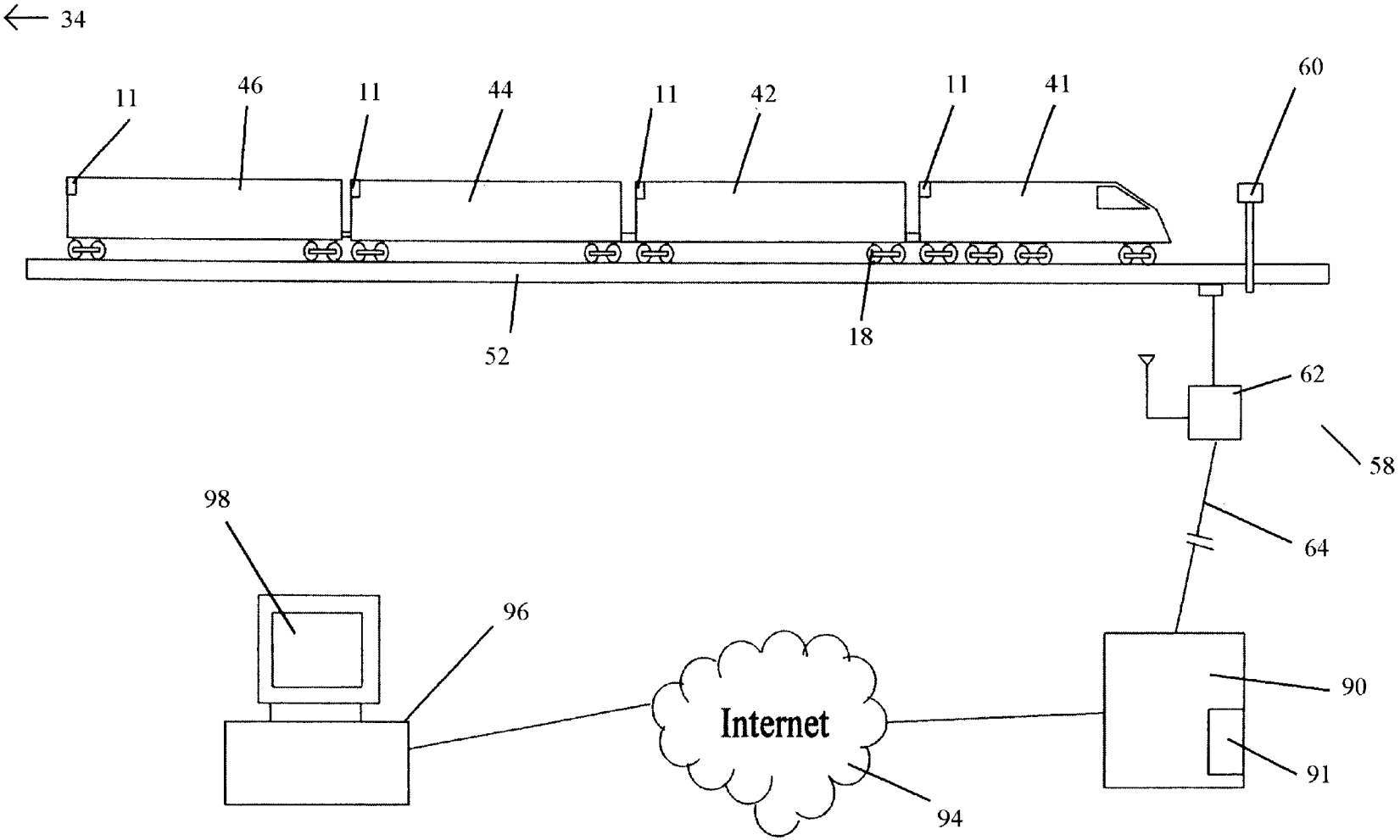
FIG. 3 is a schematic view of a train passing a monitoring station component of the present invention.

Referring now to FIG. 3, as train 40 travels along track 52, its progress is periodically monitored by monitoring stations positioned along the rail line. For example, as train 40 passes a train monitoring station 58 information concerning the train is read by the monitoring station and transmitted via communications line 64 to remote computer 90. In this particular example, train 40 consists of locomotive 45, and cars 42, 44, and 46. Each of these cars and the locomotive all have particular ID numbers displayed on tags 11. For this example, locomotive 45 has the identification number L01, whereas cars 42, 44, and 46 have ID numbers C01, C02, and C03. As train 40 passes monitoring station 58, tag reader 60 reads tags 11 as the train passes. At approximately the same time, wheel monitor 62 counts the wheels on train 40 as the train passes. Hence, as train 40 passes monitoring station 58, wheel counting monitor 62 counts the trains twenty wheels and transmits the wheel count information to remote computer 90. Tag reader 60 then reads tags 11 which identifies each rail car making up train 40 in sequential order and transmits this identification information to remote computer 90 which stores it in computer memory 91. The software pre-loaded in memory 91 is adapted to create a wheel count profile for the train by combining the wheel count for the train with the sequential order of the rail cars on the train. Since the number of wheels on each rail car is known, it is possible to adapt the software to specify the wheels corresponding to each of the rail cars in the train. In this particular example, the profile shows that wheels 1 to 8 correspond to locomotive 45 (ID L01), wheels 9 to 12 correspond to car 42, wheels 13 to 16 correspond to rail car 44 and wheels 17 to 20 correspond to rail car 46. This wheel count profile is summarized in table 1.

TABLE 1

| ID Number | Wheel position |
|---|---|
| L01 | 1–8 |
| C01 | 9–12 |
| C02 | 13–16 |
| C03 | 17–20 |

Number of wheels on train 40 (wheel count) = 20 wheels

The software loaded into memory 91 is adapted to organize the wheel profile for the train into a relational database which references each rail car to its corresponding train. The database is also adapted to permit the software to search for particular rail cars by a variety of identifying factors such as identification number, customer name, destination, starting point and any other identifying factor which may be required by users. The software is further adapted to create a location point for the train as soon as the train passes wheel monitor 62, the location point for the train corresponding to the known location the wheel monitor. The software is adapted to store the location point for the train in the database. Since each rail car is part of the train, the location of each rail car (i.e. the rail car location) will correspond to the location point for the train. As will be explained below, the software is further adapted to update the location point for train 40 as the train passes wheel counting stations along the track.

Each train has a schedule summarizing the identification of each of the cars in the train, the route the train is to take and the location of customer drop off and pick up points. It will be appreciated, that as rail cars are added to or removed from the train, the number of wheels on the train will change as the train progresses from customer location to customer location. The train schedule is, in effect, a list of predicted changes in the wheel profile of the train. The software is adapted to use the schedule for each train to generate a list of predicted wheel counts for the train corresponding to the number of wheels on the train at various locations along the track and to match those predicted wheel counts to the actual number of train wheels counted by the wheel counting monitors. In this way, the software can continuously update the database to reflect the last recorded location of the train as the train passes progressive wheel counting monitors.

Figure 4:
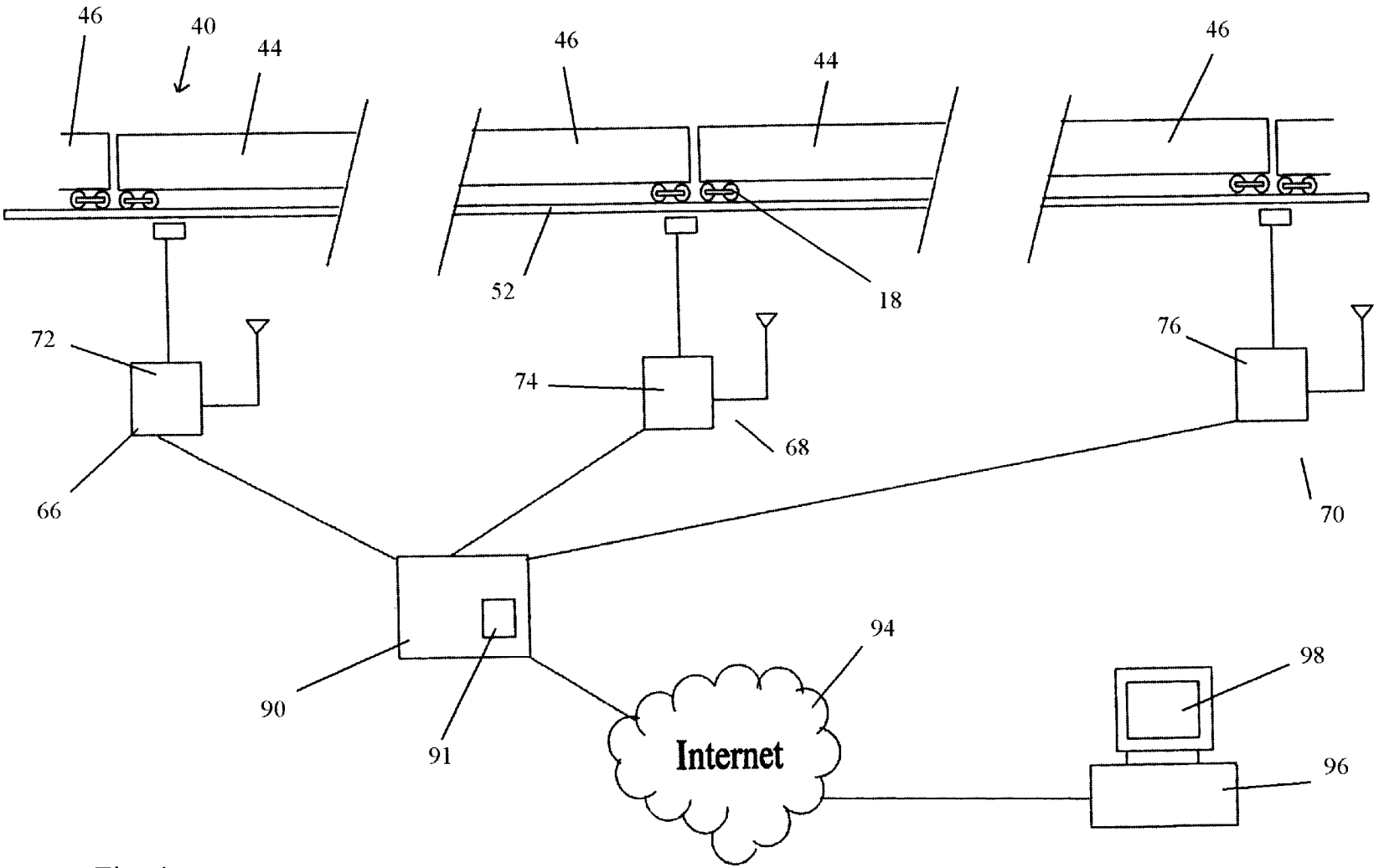
FIG. 4 is a schematic view of the train shown in FIG. 3 as it passes a series of rail monitoring stations.

Referring now to FIG. 4, as train 40 continues along track 52 the train will pass a series of wheel counting (monitoring) stations placed along the track. The exact location of each wheel counting station is known and is preferably pre-loaded in computer memory 91. As train 40 passes wheel counting monitors 72, 74, and 76, the wheel counting monitors will transmit the time the train passes each monitor, the number of wheels counted at each monitor (the updated wheel count) and the speed and direction of the wheels measured at each wheel monitor. This information is immediately relayed to computer 90 where it is stored in memory 91. The software loaded into memory 91 is preferably adapted to identify train 40 by its wheel count. Since only a relatively few number of trains will have the exact same number of wheels at any given time, the software loaded in memory 91 can identify train 40 by matching the updated wheel counts to the number of wheels on the train recorded in memory 91. Hence, when wheel counting monitor 74 reports the passage of a train having an updated wheel count matching the number of wheels on train 40, the software in memory 91 will identify the train passing monitor 74 as train 40. The software is preferably further adapted to update the location point for the train to correspond to the location of the wheel monitor which generated the last matching wheel count (in this case monitor 74).

Preferably, the software in memory 91 is further adapted to calculate a predicted rail car and train location at any given time by adding to the last location point the product of multiplying the last recorded speed of the train by the time interval since the train was last identified. In this way, computer 90 can generate not only the last confirmed position of train 40 (and therefore, the last confirmed position of any rail car on the train) but also the predicted location of the train. This provides accurate information as to the exact real time location of train 40 and, therefore, accurate information on the real time location of any rail car on the train.

As train 40 passes monitoring stations 66, 68 and 70, the wheel count profile for the train is verified and the information concerning the train is updated. Since the positions of train monitoring stations 66, 68 and 70 are known, the location of car 46 is updated periodically as train 40 progresses down track 52. Hence a user logging on to computer 90 from computer terminal 96 via the internet 94, can display information on computer screen 98 relating to the progress of car 46 as the car travels down track 52. Since the train monitoring stations also measure the speed and direction of the wheels, and therefore the rail car, the database loaded into memory 91 can display for the user the estimated time of arrival of car 46 at the next monitoring station or at the final destination. Hence, the user can have current and accurate information concerning the exact location of any rail car.

In the event rail car 46 is inadvertently decoupled from train 40, the wheel count of the train at the next wheel monitoring station will not correspond to the wheel count information contained in memory 91 of computer 90. Personnel monitoring the progress of train 40 can then note the discrepancy and inform the train's conductor that a rail car has been decoupled. Furthermore, since the profile and location point information are periodically updated, the approximate location of the missing rail car can be elucidated and the appropriate action may be taken to collect the missing rail car.

Preferably the rail monitoring stations are spaced every five kilometers or so along track 52. The relatively close spacing of monitoring stations permits very accurate information to be relayed to users as to the progress of train 40 and any particular rail car on that train. Since the method of the present invention uses relatively inexpensive wheel monitors to identify trains, and since it is possible to link several wheel monitors to a relay station via radio modems, the entire system may be relatively inexpensive to construct and maintain.

Figure 5:
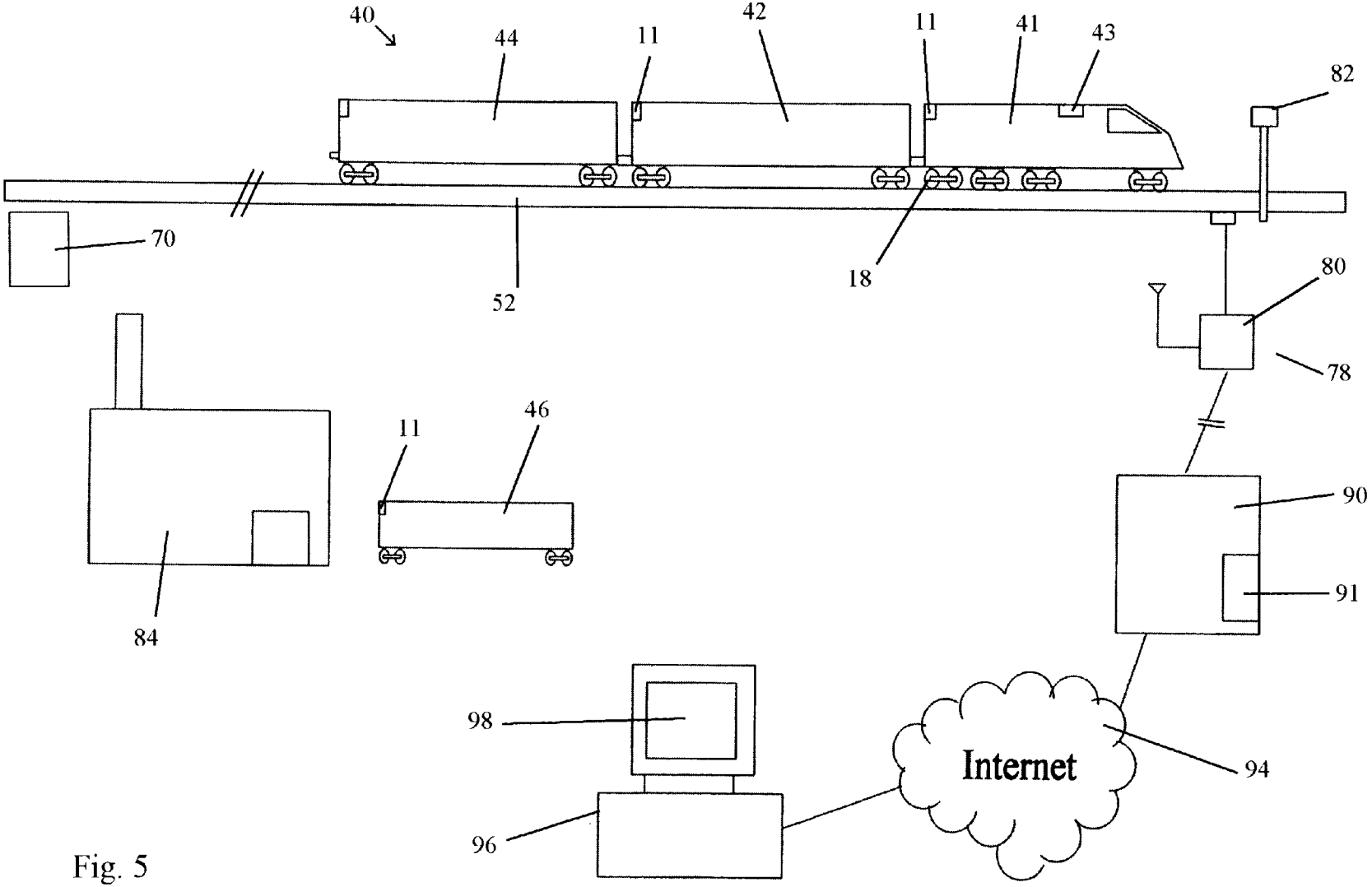
FIG. 5 is a schematic view of a train dropping off a rail car at a customer location.

Referring now to FIG. 5, after train 40 passes rail monitoring station 70, it passes customer facility 84 where it drops off rail car 46. Train 40 then continues down track 52 where it passes monitoring station 78. Wheel monitor 80 of monitoring station 78 then counts wheels 18 of train 40 and transmits the updated wheel count to computer 90. The wheel count profile for train 40 is then updated as summarized in Table 2.

TABLE 2

| ID Numbers | Wheel Count |
|---|---|
| L01 | 1–8 |
| C01 | 9–12 |
| C02 | 13–16 |

Predicted wheel count for the train at wheel monitor 80 = 16 wheels
Actual number of wheels counted on the train at monitor 80 = 16 wheels Since the train was scheduled to drop off a car having 4 wheels at customer location 84 located between monitoring stations 70 and 78, the software loaded into memory 91 calculates the predicted wheel count for the train at monitor 80 (in this case 16 wheels). If the actual wheel count at wheel counting monitor 80 corresponds to the predicted wheel count, then the software confirms that car 46 was dropped off at customer location 84. A remote user logging on to computer 90 from computer terminal 96 can then verify that car C03 was dropped off at customer location 84 and that car C02 is still aboard train 40.

Train monitoring station 78 will have wheel monitor 80, but may or may not have tag reader 82. Even if monitoring station 78 does not have tag reader 82, the monitoring station can update computer 90 on the progress of train 40 as it passes the monitoring station. The software is adapted to identify the train by matching the number of wheels counted at monitor 80 to the predicted wheel count for train 40 as derived from the train schedule. If a second train (not shown) passes monitor 80 before train 40 reaches it, the software will not identify the second train as train 40 since there will most likely be a different number of wheels on the second train. When the software identifies train 40, it amends the database to update the location point of the train to correspond to the location of the last wheel counting station to count the number of wheels on the train (in this case, monitor 80).

An alternate method of identifying the train as it passes a monitoring station is to query an identification transponder (item 40) on the train. Many trains are equipped with radio transponders which transmit radio signals identifying the train. These transponders are generally located in the locomotive. When triggered, these transponders send out an electromagnetic signal containing an identification sequence particular to that locomotive. Monitoring station 78 communicates with transponder 43 and transmits the identification information received from transponder 43 to remote computer 90. Wheel monitor 80 then counts the wheels on train 40 and transmits the updated wheel count information to computer 90. Since memory 91 contains the train identification number as well as the updated wheel count information and the list of drop offs and pick ups for that train, computer 90 can monitor the progress of the train to ensure that it is dropping off and picking up cars as scheduled.

Figure 6:
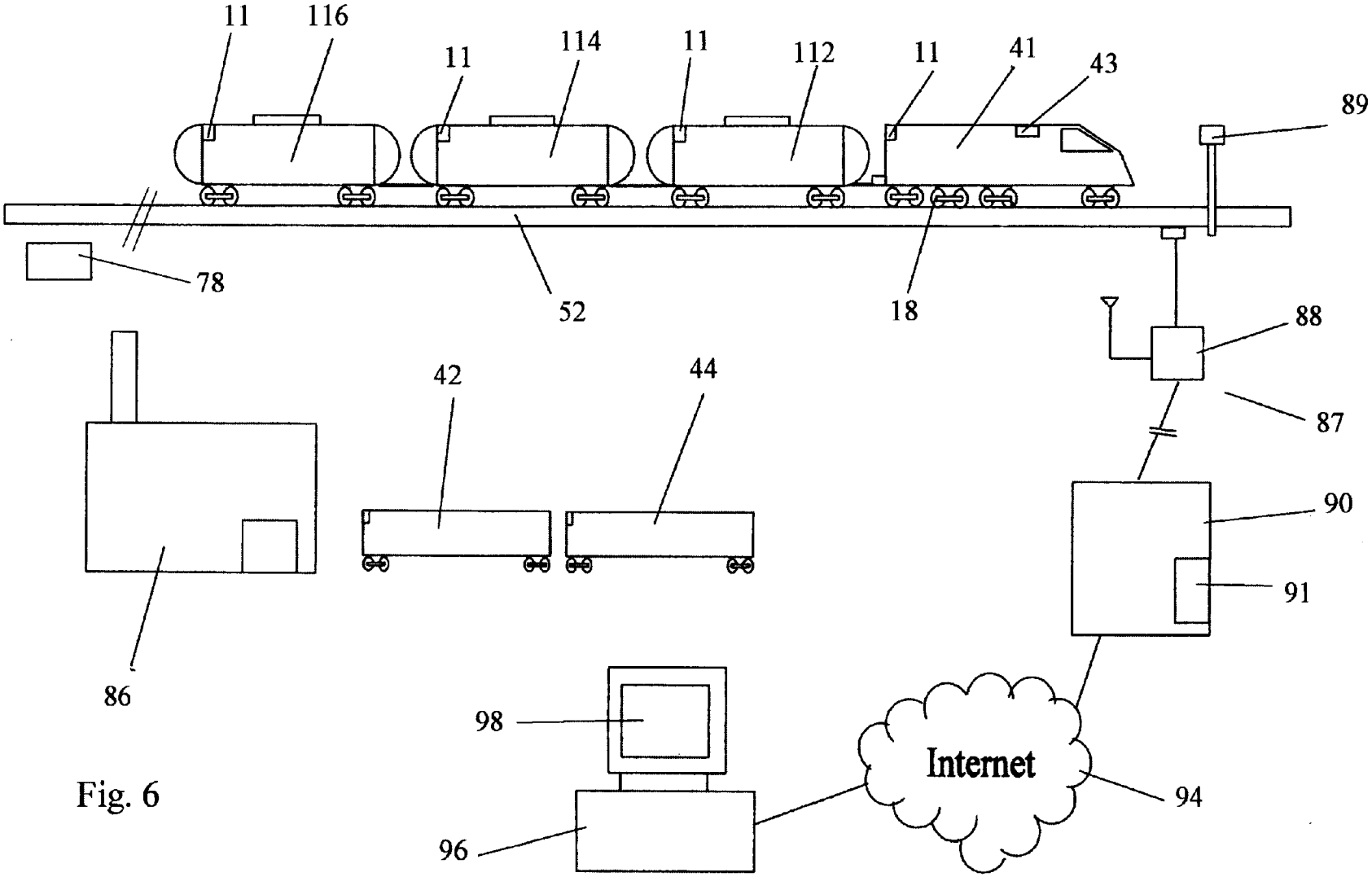
FIG. 6 is a schematic view of a train picking up and dropping off additional rail cars at another customer location.

Referring now to FIG. 6, as train 40 continues down track 52, it will drop off rail cars 42 and 44 at another customer location 86 as specified in the schedule. While at customer location 86, train 40 may pick up rail cars 112, 114 and 116, again according to the schedule for the train. When train 40 passes monitoring station 87, wheel monitor 88 counts wheels 18 on train 40 and transmits this information to computer 90 which stores the information in memory 91. Computer 90 then compares the wheel count for train 40 to the predicted wheel counts to ensure that the correct cars have been dropped off and picked up. For example, on the train schedule corresponding to train 40, cars 42 and 44 (corresponding to car ID #C01 and C02) were to be dropped off at customer location 86. Also according to the schedule for train 40, cars 112, 114 and 116 were to picked up at customer location 86. Since the schedule will specify the type of cars that are being picked up at customer location 86, computer 90 will be able to calculate that train 40 should have dropped off 8 wheels (corresponding to cars C01 and C02) and gained 12 wheels (corresponding to cars 112, 114, and 116) for a predicted wheel count of 20 wheels. As train 40 passes monitoring station 87, wheel monitor 88 counts the number of wheels and transmits the latest wheel count information to computer 90 which compares the counted number of wheels to the number of wheels predicted from the schedule. If the latest wheel count matches the predicted number of wheels on the train, then computer 90 verifies that the train is progressing as scheduled. Computer 90 then updates the location point for the train to correspond to the location of the last wheel monitor to count the number of trains on the wheel (in this case, monitoring station 87) and can therefore calculate the location point of the rail cars riding in the train. Again a user can verify the location of cars 42 and 44 by using a computer terminal 96 which is operatively coupled via internet 94 to remote computer 90. If monitoring station 87 also has a tag reader 89, then the tag reader will read tags 11 on newly configured train 40 and transmit the tag information to computer 90. Computer 90 then updates the wheel count profile for train 40 in memory 91.

The system of the present invention is also useful in maximizing the train traffic on a track. The maximum train traffic on a track is governed by the average separation between the trains. Decreasing the distance separating trains will increase the number of trains on the track. The distance separating each train is preset to exceed the minimum safe stopping distance of each train. Since the wheel counting system disclosed herein keeps track of the speed and direction of the train as well as the number of wheels on the train and the identity of the rail cars, it is possible for the computer to calculate a minimum safe stopping distance for each train. By calculating a minimum safe distance for each train, the separation between trains can be tailored to maximize the number of trains on the track.

Generally speaking, the larger a train is, the more it will weigh, and the longer the stopping distance required. Likewise, the faster a train is travelling, the greater the stopping distance required for the train. Calculating a safe stopping distance for a train is simply a mater of plugging the mass and speed of the train into an equation. Hence, by estimating the weight of the train, the computer can calculate a safe stopping distance for the train from the known speed of the train. The weight of the train can be estimated from the wheel count of the train simply by multiplying the number of wheels on the train by a weight factor. The weight factor can be predetermined to represent the estimated maximum weight of a train per wheel. For example, if we assume the weigh factor to be 5 tons/wheel, the weight of a train having twenty wheels can be estimated to be no more than 100 tons. If the speed of the train is known, then an acceptable stopping distance for the train can be calculated.

A more accurate safe stopping distance can be calculated if the identity of the rail cars are known. The identification information for each rail car should include the approximate weight of the rail car. If all of the rail cars on a train are identified, then the computer can calculate a fairly accurate weight for the train by summing all of the weights of the rail cars. The computer can then calculate a more accurate minimum safe stopping distance for the train.

With the minimum safe stopping distances for each train on the track calculated, an operator can instruct to various trains to adjust their speeds to minimize the separation between trains. The central computer can be pre-loaded with software adapted to automatically calculate the minimum safe stopping distance for each train from the wheel count, speed, direction and composition of the train.

Specific embodiments of the present invention have been disclosed; however, several variations of the disclosed embodiments could be envisioned as within the scope of this invention. It is to be understood that the present invention is not limited to the embodiments described above, but encompasses any and all embodiments within the scope of the following claims.

I claim:

1. A method for determining the real time location of wheeled rail cars linked together in a train traveling on a fixed track, the method comprising the following steps:

a) creating a count and location point for the train by counting the number of wheels on the train in sequential order as the train passes a first counting station having a known location, the location point corresponding the location of the first counting station;

b) recording the count and location point in a computer, c) identifying the train as the train passes subsequent counting stations positioned along the track by recounting the wheels on the train and matching the number of recounted train wheels to the count, each of said counting stations having a known location, d) updating the location point in the computer when the train is identified to correspond to the location of the last counting station to count the number of wheels on the train, e) creating a rail car location in the computer, the rail car location corresponding to the last updated location point for the train, f) providing each rail car with an identification tag, g) identifying each of the rail cars in the train in sequential order as the train passes an identification tag reading station, the identification tag reading station adapted to read the identification tag and transmit the sequential identity of the cars to the computer, h) creating a wheel profile for the train by combining the wheel count and the sequential identity of the cars, the wheel profile listing the number of wheels on the train and the identification of each of the rail cars on the train, i) recording a train schedule in the computer, the train schedule including a list of customer locations where the rail cars will be transferred and a list of the rail cars transferred at those respective customer locations, and j) amending the wheel profile for the train as the train travels from customer locations by changing the wheel profile to reflect the scheduled transfer of the rail cars at the respective customer locations, the amended wheel profile containing a predicted number of wheels on the train and a predicted list of rail car identities.

2. The method of claim 1 further comprising the steps of verifying the transfer of rail cars at a customer location by counting the number of wheels on the train as the train passes a counting station positioned after the customer location to the predicted number of wheels on the train according to the amended wheel profile.

3. The method of claim 2 further comprising the steps of re-identifying each of the rail cars in the train as the train passes another identification tag reading station, said station adapted to transmit the identity of the cars to the computer, and updating the wheel profile for the train to reflect the re-identified rail cars.

4. The method of claim 1 further comprising the steps of identifying the train as the train passes subsequent counting stations positioned along the track by re-recounting the wheels on the train and matching the number of recounted train wheels to the predicted number of wheels on the train, each of said counting stations having a known location, and updating the rail car location by changing the updated location point in the computer to correspond to the location of the last counting station to count the wheels on the train.

5. A system for determining the real time location of wheeled rail cars linked together in a train travelling on a fixed track, the system comprising:

a) a plurality of counting stations positioned along the track, the counting stations each adapted to accurately count the wheels of the train as the train passes the station to create a wheel count for the train, the wheel count corresponding to the total number of wheels of the train counted by the counting station, each counting station having a known location;

b) the counting stations being adapted to transmit an information signal to a first computer operatively coupled to the counting stations when the train passes the stations, said information signal including the wheel count for the train and location information corresponding to the location of the counting station generating the wheel count;

c) the first computer adapted to store the wheel count and location information in a memory module;

d) the first computer adapted to identify the train when it passes each counting station by matching the number of wheels of the train counted by said counting station to the wheel count for the train;

e) the first computer adapted to generate a location point corresponding to the location of the last counting station to count the number of wheels on the train, f) the first computer further adapted to create a rail car location corresponding to the location point;

g) the counting stations are further adapted to measure the speed and direction of the wheels on the train and the time the wheel count was taken, the counting stations being further adapted to transmit this information to the first computer;

h) each of the rail cars have identification tags identifying the rail car and further comprising at least one identification tag reading station positioned adjacent to the track and operatively coupled to the first computer, the identification tag reading station adapted to read the identification tags of the rail cars to identify each of the rail cars in the train in sequential order as the train passes the identification tag reading station, the identification tag reading station adapted to transmit the sequential identity of the cars to the first computer, the identification tag reading station positioned near a counting station, the first computer adapted to store the identity of each of the rail cars forming the train;

i) the first computer is further adapted to create a wheel profile for the train by combining the wheel count and the identities of the cars read from the identification tag reading station, the wheel profile listing the number of wheels on the train and the identification of each of the rail cars on the train;

j) wherein the first computer is further adapted to store a train schedule, the train schedule including a list of customer locations where the rail cars will be transferred and a list of the rail cars transferred at the respective customer locations, and wherein the first computer is further adapted to amend the wheel profile for the train as the train travels from a first customer location to a second customer location by changing the wheel profile to reflect the transfer of the rail cars, the amended wheel profile containing a predicted number of wheels on the train and a predicted identification list for the rail cars in the train.

6. The system of claim 5 wherein the first computer is further adapted to identify the train as the train passes subsequent counting stations positioned along the track by matching the number of wheels counted for the train by said counting stations to the predicted wheel count for the train, the first computer being further adapted to update the rail car locations when the train is identified by changing the updated location point to correspond to the location of the last counting station which read the wheels on the train.

7. The system of claim 6 wherein the first computer is further adapted to verify the transfer of rail cars at a customer location by comparing the number of wheels on the train counted when the train passed a wheel counting station positioned after the customer location to the predicted number of wheels on the train according to the amended wheel profile.

8. The system of claim 7 further comprising a plurality of identification tag reading stations positioned along the track, said stations adapted to transmit the identity of the cars in the train passing said stations to the first computer, and wherein the first computer is adapted to update the wheel profile for the train to reflect the re-identified rail cars.

9. A method for determining the real time location of wheeled rail cars linked together in a train traveling on a fixed track, the method comprising the following steps:

a) creating a wheel count and a location point for the train by counting the number of wheels on the train in sequential order as the train passes a first wheel counting station having a known location, the location point corresponding the location of the first wheel counting station;

b) recording the wheel count and location point in a computer, c) identifying the train as the train passes subsequent wheel counting stations positioned along the track by recounting the wheels on the train and matching the number of recounted train wheels count, each of said wheel counting stations having a known location, d) updating the location point in the computer when the train is identified to correspond to the location of the last wheel counting station to count the number of wheels on the train, and e) creating a rail car location in the computer, the rail car location corresponding to the last updated location point for the train, wherein the first computer is further adapted to transmit the location point to a remove computer via the world wide web.

10. A system for determining the real time location of wheeled rail cars linked together in a train traveling on a fixed track, the system comprising:

a) a plurality of counting stations positioned along the track, the counting stations each adapted to accurately count the wheels of the train as the train passes the station to create a wheel count for the train, the wheel count corresponding to the total number of wheels of the train counted by the counting station, each counting station having a known location;

b) the counting stations being adapted to transmit an information signal to a first computer operatively coupled to the counting stations when the train passes the stations, said information signal including the wheel count for the train and location information corresponding to the location of the counting station generating the wheel count;

c) the first computer adapted to store the wheel count and location information in a memory module;

d) the first computer adapted to identify the train when it passes each counting station by matching the number of wheels of the train counted by said counting station to the wheel count for the train;

e) the first computer adapted to generate a location point corresponding to the location of the last counting station to count the number of wheels on the train, f) the first computer further adapted to create a rail car location corresponding to the location point, g) the counting stations are further adapted to measure the speed and direction of the wheels on the train and the time the wheel count was taken, the counting stations being further adapted to transmit this information to the first computer, h) each of the rail cars have identification tags identification tags identifying the rail car and further comprising at least one identification tag reading station positioned adjacent to the track and operatively coupled to the first computer, the identification tag reading station adapted to read the identification tags of the rail cars to identify each of the rail cars in the train in sequential order as the train passes the identification tag reading station, the identification tag reading station adapted to transmit the sequential identity of the cars to the first computer, the identification tag reading station positioned near a counting station, the first computer adapted to store the identity of each of the rail cars forming the train, i) the first computer is further adapted to create a wheel profile for the train by combining the wheel count and the identities of the cars read from the identification tag reading station, the wheel profile listing the number of wheels on the train and the identification of each of the rail cars on the train, j) the first computer is further adapted to store a train schedule, the train schedule including a list of computer locations where rail cars will be transferred and a list of the rail cars transferred at the respective customer locations, and wherein the first computer is further adapted to amend the wheel profile for the train as the train travels from a first customer location to a second customer location by changing the wheel profile to reflect the transfer of rail cars, the amended wheel profile containing a predicted number of wheels on the train and a predicted identification list for the rail cars in the train, k) the first computer is further adapted to identify the train as the train passes subsequent counting stations positioned along the track by matching the number of wheels counted for the train by said counting stations to the predicted wheel count for the train, the first computer being further adapted to update the rail car locations when the train is identified by changing the updated location point to correspond to the location of the last counting station which read the wheels on the train, l) the first computer is further adapted to verify the transfer for rail cars at a customer location by comparing the number of wheels on the train counted when the train passed a counting station positioned after the customer location to the predicted number of wheels on the trains according to the amended wheel profile, m) wherein the first computer is further adapted to search for a specific rail car by corresponding rail car identify information and transmit the location point and estimated rail car location for said specific rail car to a remote computer via the world wide web.

11. A method for determining the real time location of wheeled rail cars linked together in a train traveling on a fixed track, the method comprising the following steps:

creating a first wheel count and location for the train by counting the number of wheels on the train in sequential order as the train passes a first wheel counting station having a known location;

recording a first wheel count in a computer;

identifying the train as the train passes a second wheel counting station positioned along the track;

counting the wheels on the train and matching the number of wheels to the first wheel count;

updating a location position in said computer corresponding to the second wheel counting station; and recording a train schedule in said computer.

12. A method for determining the real time location of wheeled rail cars linked together in a train traveling on a fixed track, the method comprising the following steps:

creating a first wheel count and a location for the train by counting the number of wheels on the train in sequential order as the train passes a first wheel counting station having a known location;

recording a first wheel count in a computer;

identifying the train as the train passes a second wheel counting station positioned along the track;

counting the wheels on the train and matching the number of wheels to the first wheel count;

updating a location position in said computer corresponding to the second wheel counting station;

providing said rail cars with an identification tag for identifying the rail cars;

creating a wheel profile for said train; and amending said wheel profile to reflect a transfer of a rail car at location.

13. The method of claim 12, further comprising verifying said transfer of rail cars at said location following departure from said location.

14. The method of claim 13, wherein said transfer verification step further comprising counting a quantity of wheels on said train at said second wheel counting station.

15. The method of claim 13, further comprising passing an identification tag reading station for identifying each of said cars subsequent to departing said location.

16. The method of claim 15, further comprising updating said wheel profile and transmitting said profile and identification of said cars to said computer.

17. The method of claim 13, further comprising comparing said quantity of wheels to a predicted quantity of wheels.

18. A method for determining the real location of wheeled rail cars linked together in a train traveling on a fixed track, the method comprising the following steps:

creating a first wheel count and a location for the train by counting the number of wheels on the train in sequential order as the train passes a first wheel counting station having a known location;

recording a first wheel count in a computer;

identifying the train as the train passes a second wheel counting station positioned along the track;

counting the wheels on the train and matching the number of wheels to the first wheel count;

updating a location position in said computer corresponding to the second wheel counting station;

measuring and transmitting wheel profile data from said wheel counting stations to said computer; and transmitting data from said computer to a remote computer via a global computer network.

19. A method for determining the real time location of wheeled rail cars linked together in a train traveling on a fixed track, the method comprising the following steps:

creating a first wheel count and a location for the train by counting the number of wheels on the train in sequential order as the train passes a first wheel counting station having a known location;

recording a first wheel count in a computer;

identifying the train as the train passes a second wheel counting station positioned along the track;

counting the wheels on the train and matching the number of wheels to the first wheel count;

updating a location position in said computer corresponding to the second wheel counting station;

measuring and transmitting wheel profile data from wheel counting stations to said computer; and searching for said rail car location through use of said profile data.

20. A system for determining location of wheeled rail cars on a fixed track comprising:

a plurality of wheel counting stations positioned at specific locations along said track;

a computer adapted to receive a signal from said wheel counting stations, said signal provides said computer with a wheel count and station location;

a memory module within said first computer to store said wheel count and said station location; and a data manager for compiling train identifying information, wherein said computer stores train schedule data.

21. The system of claim 20, wherein said data manager is adapted to amend a wheel profile of said train as said train travels among customer locations and transfers rail cars.

22. The system of claim 21, wherein said data manager transmits amended wheel profile data to said computer.

23. The system of claim 21, wherein said computer transmits said train identifying information to a remote computer via a global computer network.

24. The system of claim 23, wherein said remote computer is adapted to receive search queries for identifying rail car location.

* * * * *